US006365030B1

(12) United States Patent
Yoshimura et al.

(10) Patent No.: US 6,365,030 B1
(45) Date of Patent: Apr. 2, 2002

(54) METHOD OF MANUFACTURING R-FE-B BOND MAGNETS OF HIGH CORROSION RESISTANCE

(75) Inventors: Kohshi Yoshimura, Amagasaki; Fumiaki Kikui, Osaka; Takeshi Nishiuchi, Ibaraki, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/530,452

(22) PCT Filed: Oct. 19, 1998

(86) PCT No.: PCT/JP98/04718

§ 371 Date: May 10, 2000

§ 102(e) Date: May 10, 2000

(87) PCT Pub. No.: WO99/23676

PCT Pub. Date: May 14, 1999

(30) Foreign Application Priority Data

Oct. 30, 1997 (JP) ..... 9-316436

(51) Int. Cl.[7] ..... C25D 5/34; C25D 17/16; C23C 28/00; C23C 28/02

(52) U.S. Cl. ..... 205/206; 205/143; 205/183; 205/145; 205/187

(58) Field of Search ..... 205/206, 143, 205/183, 145, 184, 187

(56) References Cited

U.S. PATENT DOCUMENTS 5,273,782 A * 12/1993 Sagawa et al. ..... 427/242
5,302,464 A * 4/1994 Nomura et al. ..... 428/551

FOREIGN PATENT DOCUMENTS

JP 06-079613 A * 3/1994
JP 07-034062 A * 2/1995
JP 07-201620 A * 8/1995
JP 07-272922 A * 10/1995
JP 09-027433 A * 1/1997

* cited by examiner

*Primary Examiner*—Edna Wong
(74) *Attorney, Agent, or Firm*—Dykema Gossett PLLC

(57) ABSTRACT

A method of manufacturing R—Fe—B bonded magnets, capable of forming various corrosion resisting films on a R—Fe—B bonded magnet uniformly with a very high bonded strength so as to attain such a very high corrosion resistance thereof that prevents the bonded magnet from being rusted even in a long-period high-temperature high-humidity test; comprising barrel-polishing a porous R—Fe—B bonded magnet by a dry method using as media an abrasive stone formed by sintering inorganic powder of $Al_2O_3$, SiC, ZrO and MgO, or a mixture of an abrasive for metal balls and vegetable media, such as vegetable skin chips, sawdust, rind of a fruit and a core of corn, or a mixture of vegetable media the surfaces of which are modified by the above-mentioned abrasive and the above-mentioned inorganic pulverized bodies, so as to enable a surface of the magnet to be smoothed and sealed.

7 Claims, No Drawings

METHOD OF MANUFACTURING R-FE-B BOND MAGNETS OF HIGH CORROSION RESISTANCE

TECHNICAL FIELD

This invention relates to an improved method of manufacturing R—Fe—B bonded magnets, and more particularly to an improved method of manufacturing highly corrosion-resistant R—Fe—B bonded magnets exhibiting outstanding corrosion resistance and bonding characteristics wherein, using dry barrel polishing, polishing material powder and bonded magnet grindings, or those together With inorganic powder, are imbedded and sealed in the pores of the magnet, and modification is effected in a surface smoothing treatment, after which a non-electrolytic plating layer is formed directly to the surface of the magnet material, a uniform electrically conducting layer is formed as an underlayer, and a highly corrosion-resistant electrolytic plating layer is deployed that can be efficiently formed with good volume productivity, without limiting the plating solution for electrolytic nickel plating or the like.

BACKGROUND ART

Today, in the rubber magnets and plastic magnets called bonded magnets, which are made in various shapes such as ring shapes and disk shapes, advances are being made toward higher performance, moving from conventional isotropic bonded magnets to anisotropic bonded magnets, and from ferrite-based bonded magnets to rare earth bonded magnets which exhibit higher magnetic properties, and also from Sm—Co magnetic materials to R—Fe—B bonded magnets which use R—Fe—B magnetic materials exhibiting, in sintered magnets, high magnetic properties, with a maximum energy product of 50 MGOe or higher.

There is a problem with R—Fe—B magnets in that they rust easily due to their composition which contains large quantities of Fe and a component phase that oxidizes extremely readily, and the surfaces thereof have been coated with resin layers of various compositions by electrodeposition, spraying, immersion, or impregnation, etc. (cf. Japanese Patent Application Laid-Open No. H1-166519/1989, Japanese Patent Application Laid-Open No. H1-245504/1989).

With the resin coating methods used to date for enhancing the corrosion resistance of R—Fe—B bonded magnets, as in the case of ring-shaped bonded magnets using a spraying method, for example, coating material loss is great, and many process steps are involved due to the necessity of reversing the front and back, and there has also been the problem of deterioration in film thickness uniformity.

With the electrodeposition method, moreover, although the film thickness is uniform, each magnet must be attached to an electrode, which requires more process steps and is unsuitable for small magnets. In addition, the electrodes leave marks that must be removed after the coating is made, thus requiring a touch-up operation. Hence this method is problematic in that it requires many process steps and is unsuitable for small magnets. Using the immersion method, it is very difficult to obtain coated films of certain uniform thickness due to dripping and other problems. With porous bonded magnets, moreover, the pores are not adequately filled in, resulting in such problems as swelling during drying and the products sticking together.

When the volume productivity of methods for generating metal coating films is considered, one possibility is to implement electrolytic metal plating conducted with sintered R—Fe—B magnets (cf. Japanese Patent Application Laid-Open No. S60-54406/1985, Japanese Patent Application Laid-Open No. S62-120003/1987), but the surfaces of R—Fe—B bonded magnets are porous and expose a resin portion of low electrical conductivity. As a consequence, plating solution remains, the plating film is not adequately produced on the resin part resulting in pin holes (unplated portions), and rusting occurs.

Thereupon, proposals have been made for selecting plating solution that are harmless even if they penetrate into a porous bonded magnet and remain there (Japanese Patent Application Laid-Open No. H4-276092/1992), and for methods of plating after forming a resin coating on the underlayer (Japanese Patent Application Laid-Open No. H3-11714/1991, Japanese Patent Application Laid-Open No. H4-276095/1992).

It is very difficult, however, to make plating solution completely harmless and these are not solutions that exhibit good film-forming efficiency. Also, the variation in the thickness of the underlayer is a destabilizing factor in plating layers, and to apply an undercoating of sufficient thickness would lead to the contradiction of the plating layer on the surface becoming unnecessary.

Plating solutions of specific compositions have been proposed as a method for implementing nickel plating with good film-forming efficiency on R—Fe—B bonded magnets (Japanese Patent Application Laid-Open No. H4-99192/1992), but here again there is still a danger that such solutions will penetrate into the bonded magnet, remain there, and cause rusting.

In terms of the structural material, on the other hand, the copper strike plating customarily performed prior to nickel plating is either strongly alkaline or strongly acidic, and hence is not suitable for processing R—Fe—B bonded magnets.

In order to impart wear resistance to electronic components, furthermore, and as an anticorrosion treatment for automobile steel panels and the like, practical NiP plating has been developed of a high-temperature acidic solution type, but this is unsuitable for application to R—Fe—B bonded magnets because it causes corrosion in the interior of the magnet.

Thereupon, in the interest of providing R—Fe—B bonded magnets, and a method of manufacture therefore, configured such that plating solution and cleaning fluids, etc., are prevented from penetrating into and remaining in porous R—Fe—B bonded magnets, wherewith a nickel-plated layer or other plating layer can be formed efficiently, and wherewith corrosion resistance and heat resistance can be sharply improved, a method has been proposed wherewith the magnet is subjected to a process for impregnating it with a resin or an inorganic material such as glass to impregnate the pores in the magnet with the resin or inorganic material such as glass, wherewith a surface polishing treatment is then performed such as a barrel-polishing treatment or sandblasting treatment.

Such impregnation and surface polishing treatments are indeed able to modify the surfaces of R—Fe—B bonded magnets while preserving the impregnation effects. However, these are wet polishing treatments and are therefore unsuitable for such easily rusted materials as R—Fe—B bonded magnets due to the corrosion resistance problem. In other words, corrosion resistance deteriorates with rusting developing from the interior so that the plating layer peels away, etc.

A method has also been proposed wherewith the magnet is coated with a mixture of a resin and an electrically conducting powder, an electrically conducting film layer is formed on the surface of the bonded magnet material, and then a surface smoothing treatment is performed (Japanese Patent Application Laid-Open No. H8-186016/1996).

Both of the methods described above are undesirable, however, because various resins are employed to seal the holes in the magnet material, leading unavoidably to the tedious processing steps of resin application (impregnation), curing, and smoothing treatment, and thus, from an industrial perspective, these methods inherently involve the possibility of higher costs.

With a method for coating (impregnating) the magnet material with a resin, it is very difficult to uniformly coat the resin onto the material surface, and, even if barrel-polishing is performed in a subsequent process step, it is very difficult to obtain products exhibiting outstanding dimensional precision. Performing the polishing in a wet process is also problematic in terms of corrosion resistance.

Today, meanwhile, R—Fe—B bonded magnets are being used in more and more applications, and, in applications used in various kinds of electronic equipment installed in automobiles, for example, high corrosion resistance is demanded in R—Fe—B bonded magnets which do not rust in high-temperature high-humidity tests.

When such corrosion resistance is considered, the corrosion-resistant coating layer provided in the magnet surface that is modified by surface-polishing in a dry method so that plating solution and the like are prevented from penetrating must be provided uniformly with even better bonding characteristics.

SUMMARY OF THE INVENTION

One object of the present invention is to provide R—Fe—B bonded magnets that exhibit high corrosion resistance and will not rust even in long-duration high-temperature high-humidity tests. Another object is to provide a manufacturing method wherewith various corrosion-resistant coating films can be formed on the R—Fe—B bonded magnets uniformly and with high bonding strength in order to realize high corrosion resistance.

Another object of the present invention is to provide a manufacturing method for highly corrosion-resistant R—Fe—B bonded magnets, comprising optimum industrial process steps for effecting corrosion-resistant coating films with high bonding strength and good dimensional precision on magnet surfaces that prevent plating solution and cleaning fluids, etc., from penetrating into and remaining in porous R—Fe—B bonded magnets.

Intent on resolving such problems, the inventors learned that, by barrel-polishing a porous R—Fe—B bonded magnet in a dry method, using as a medium a mixture of an abrasive material such as abrasive stone formed by sintering inorganic powder of $Al_2O_3$, SiC, ZrO, or MgO, or metal balls, and a vegetable medium such as sawdust, fruit rind, or corncobs, or, alternatively, a mixture of an abrasive material noted above and a vegetable medium whose surface has been modified with an inorganic powder as noted above, the surface of the magnet can be smoothed and sealed.

When the mechanism of the barrel polishing noted above was exactingly investigated, it was found that, in dry barrel polishing, it is possible, by means of the oil component in the vegetable medium used, both to bond the grindings of the surface-oxidized layers of the magnetic powder configuring a bonded magnet and the inorganic powder for modifying the surface of the vegetable medium and the powder of the abrasive material to the porous portion of that magnet, thus sealing the magnet, and simultaneously to smooth the surface thereof. From these facts it was learned that it is possible to form a non-electrolytic plating layer with a neutral or alkali solution directly to the surface of the magnet material surface after the dry barrel polishing, and that, by then forming an electrolytic plating layer, a plating film exhibiting significantly superior bonding strength and dimensional precision is obtained. Thus it was learned that a highly corrosion-resistant R—Fe—B bonded magnet exhibiting the outstanding dimensional precision sought can be obtained, and the present invention was perfected.

In other words, the present invention is a method for manufacturing highly corrosion-resistant R—Fe—B bonded magnets wherein, using as a medium a mixture of an abrasive agent and either a vegetable medium or a vegetable medium the surface whereof has been modified with an inorganic powder, the R—Fe—B bonded magnet isbarrel-polished in a dry method, powder of the abrasive agent and grindings of the bonded magnet, or also the inorganic powder, are bonded with the oil component of the vegetable medium to the porous portion of the R—Fe—B bonded magnet, both sealing that magnet and smoothing the surface thereof to modify it, after which a non-electrolytic plating layer is formed directly to the surface of that bonded magnet with a neutral or alkaline solution, and an electrolytic plating layer is then formed.

BEST MODE FOR CARRYING OUT THE INVENTION

In the present invention, the R—Fe—B bonded magnet is either an isotropic or an anisotropic bonded magnet. In the case of compression molding, such is obtained by adding a thermoplastic resin, coupling agent, and lubricant, etc., to the desired composition and property-imparting magnetic powder, kneading these together, and then compression-molding and heating to harden the resin. In the case of injection molding, extrusion molding, or rolling molding, such is obtained by adding a thermoplastic resin, coupling agent, and lubricant, etc., to the magnetic powder, kneading these together, and then molding by injection molding, extrusion molding, or rolling.

For the R—Fe—B magnetic powder, either isotropic or anisotropic powder can be used which has been obtained by any of a number of manufacturing methods including a fusion-pulverizing method wherein the desired R—Fe—B alloy is melted, cast, and then pulverized, a direct reduction diffusion method for obtaining powder directly by Ca reduction, a quick-cooling alloy method wherein the desired R—Fe—B alloy is melted, ribbon foil is obtained with a jet caster, and that is pulverized and annealed, a gas atomizing method wherein the desired R—Fe—B alloy is melted, made into powder by gas atomizing, and heat-treated, a mechanical alloying method wherein the desired raw-material metal is made into powder, then made into fine powder by mechanical alloying and heat-treating, or a method (HDDR method) wherein the desired R—Fe—B alloy is heated in hydrogen to break it down and recrystallize it.

In the present invention, the rare earth element R used in the R—Fe—B magnet powder accounts for 10 at. % to 30 at. % of the composition, but it is preferable that at least one element from the group Nd, Pr, Dy, Ho, and Tb be contained, or additionally that at least one element from the group La, Ce, Sm, Gd, Er, Eu, Tm, Yb, Lu, and Y be contained. Ordinarily, one type of R will be sufficient, but in actual practice, because of the ease of obtaining mixtures of two types or more thereof (such as misch metal or didymium), etc., such can be used. This R need not be a pure rare earth element, moreover, and, within the scope of what is industrially available, such as contains unavoidable impurities due to manufacturing may be used without any difficulty.

R is a mandatory element in the types of magnet powders noted earlier. At less that 10 at. %, the crystalline structure becomes a cubic crystalline structure identical to that of α-iron, wherefore high magnetic properties, such as high coercive force in particular, are not obtained. When 30 at. % is exceeded, on the other hand, there will be many R-rich non-magnetic phases, the residual flux density (Br) will decline, and permanent magnets with outstanding properties will not be obtained. Thus the R content should be within the range of 10 at. % to 30 at. %.

B is a mandatory element in the magnet powders noted earlier. At less than 2 at. %, a rhombohedral structure becomes the dominant phase, and high coercive force (iHc) is not obtained. When 28 at. % is exceeded, on the other hand, there will be many B-rich non-magnetic phases, and the residual flux density (Br) will decline, wherefore outstanding permanent magnets will not be obtained. Thus the B content should be within the range of 2 at. % to 28 at. %.

Fe is a mandatory element in the magnet powders noted earlier. At less than 65 at. %, the residual flux density (Br) declines, whereas when 80 at. % is exceeded, high coercive force is not obtained. Hence the Fe content should be from 65 at. % to 80 at. %.

By partially replacing the Fe with Co, the temperature characteristics can be improved without impairing the magnetic properties of the magnet. However, when the amount of Co replacement exceeds 20% of the Fe, the magnetic properties conversely deteriorate, so that is undesirable. When the Co replacement quantity is from 5 at. % to 15 at. % in the total quantity of Fe and Co, Br will increase as compared to when no replacement is made, wherefore that is desirable in order to obtain high magnetic flux In addition to R, B, and Fe, moreover, the presence of impurities that are unavoidable in industrial manufacture is permissible. For example, the permanent magnet fabricability can be improved and lower costs realized by partially replacing B with at least one element from among the group C (4.0 wt. % or less), P (2.0 wt. % or less), S (2.0 wt. % or less), and Cu (2.0 wt. % or less), in a total quantity that is 2.0 wt. % or less.

At least one element from the group Al, Ti, V, Cr, Mn, Bi, Nb, Ta, Mo, W, Sb, Ge, Ga, Sn, Zr, Ni, Si, Zn, and Hf can also be added to the magnet powder to realize the benefit or improving the coercive force, improving the squareness of the magnetism reduction curve, improving fabricability, or reducing costs. The upper limit of the added quantity should be within such range as will satisfy the various conditions required to realize the desired values for the (BH)max and Br of the bonded magnet.

In the present invention, furthermore, the binder used with injection molding may be a resin such as 6PA, 12PA, PPS, PBT, or EVA, that used with extrusion molding, calendar rolling, or rolling molding may be PVC, NBR, CPE, NR, or Hyperon, etc., and that used with compression molding may be an epoxy resin, DAP, or a phenol resin, etc. If necessary, a known metal binder can be used. Other auxiliary agents may also be used, such as a lubricant to facilitate molding, a bonding agent for the resin and inorganic filler, or a silane-based or titanium-based coupling agent.

In the present invention, the medium used when barrel-polishing is either a mixture of an abrasive agent such as ceramic material wherein inorganic powder of $Al_2O_3$, SiC, ZrO, or MgO is baked and hardened, or metal balls, and a vegetable medium such as sawdust, fruit rind, or corncobs, or a mixture of an abrasive agent noted above and a vegetable medium noted above the surface whereof has been modified with an inorganic powder of $Al_2O_3$, SiC, ZrO, or MgO, noted above. By performing the barrel-polishing treatment using such a mixture as the medium, it is possible to perform a smoothing-sealing treatment on bonded magnets.

In the dry barrel polishing in the present invention, a known barrel can be used, and a common revolving barrel with a turning speed of 20 to 50 rpm, a centrifugal barrel with a turning speed of 70 to 200 rpm, or a vibrating barrel method wherein the vibration frequency is 40 to 60 Hz and the vibration amplitude is 0.5 mm or greater but less than 50 mm can be used.

Ordinarily, moreover, the atmosphere in this barrel polishing may be atmospheric air. However, in cases where, depending on the medium, there is a worry about the magnet being oxidized due to heat of friction during barrel polishing, an inert gas atmosphere such as $N_2$, Ar, or He gas, used singly or in a mixture, may be used.

In the case of a revolving or vibrating barrel, the total quantity of bonded magnet, abrasive agent, and vegetable medium loaded into the barrel should be from 20% to 90% of the interior capacity. Below 20%, the treatment quantity is too small to be practical, whereas when 90% is exceeded, stirring is insufficient and adequate polishing cannot be effected.

In the present invention, there is no particular limit on the abrasive agent. Nevertheless, a mixture should be used containing an abrasive agent with a particle size of 1 to 7 mm and preferably 3 to 5 mm or so, and a vegetable medium with a length of 0.5 to 3 mm and preferably 1 to 2 mm or so, or, alternatively, a mixture of the abrasive agent noted above and a vegetable medium noted above wherein the surface has been modified with an inorganic powder. The magnet and medium mixture should be evenly stirred, performed under conditions wherein relative shifting motion is effected.

For the vegetable medium wherein the surface has been modified with an inorganic powder noted earlier, use may be made of such a vegetable medium wherein an oil component such as a wax has been coated by kneading onto the surface thereof, wherein the surface has then been evenly covered with an inorganic powder of $Al_2O_3$, SiC, ZrO, or MgO having a particle size of 0.01 to 3 μm, bonding that powder thereto. The powder of the abrasive agent noted above that is a sealant, the inorganic powder for modifying the surface of the vegetable medium, and the grindings from the bonded magnet have a particle size of 0.01 to 3 μm.

The volume ratio between the vegetable medium and abrasive agent in the medium (vegetable medium/abrasive agent should be from 1/15 to 2, with a mixture having a ratio of 1 being preferred. The mixture ratio between the bonded magnet and medium (bonded magnet/medium) can be made 3or lower.

In the present invention, the abrasive agent noted above functions to effectively grind away the surface oxidation layer of the magnet, to smooth the surface thereof, and to beat and harden the sealing materials constituted by the abrasive agent powder, the inorganic powder for modifying the vegetable medium surface, and the bonded magnet grindings. The vegetable medium noted above functions to enhance the bonding strength of the sealing materials by effectively releasing the oil component thereof.

In the present invention, it is possible to lower the porosity of the bonded magnet after the surface smoothing treatment to 3% or lower. It is possible not only to perform the smoothing-sealing treatment on the bonded magnet surface, but also to remove the surface oxidation layer from the magnet and thus obtain active R—Fe—B magnetic powder surfaces, and to form plating layers which exhibit extremely superior bonding properties.

In th e present invention, for the non-electrolytic plating method, a non-electrolytic plating is used that is selected from among neutral or alkaline solutions of Ni, Cu, Sn, Co, Zn, Ag, Au, or Pd. The reasons for limiting this to neutral or alkaline solution non-electrolytic plating are that such do not involve any problem of rusting or the like in the R—Fe—B magnet, and that, because a modification treatment is performed earlier, a two-play plating becomes possible with the electrolytic plating described subsequently. The non-electrolytic solution should have a pH of 7 to 12, and preferably 9 to 11, while the plating thickness should be 1 to 7 $\mu$m, and preferably 3 to 5 $\mu$m.

For the electrolytic plating method in the present invention, a plating method is desirable which contains B, S, and P, and at least one base metal selected from among Ni, Cu, Sn, Co, Zn, Cr, Ag, Au, Pd, and Pt, or some alloy thereof. The plating thickness should be 5 to 50 $\mu$m, and preferably 10 to 20 $\mu$m. The plating solution should have a pH of 5.6 or higher. In the present invention, furthermore, in order to make the, sealing treatment and non-electrolytic plating described in the foregoing effective, plating is possible also using an ordinary watt solution, and a plating layer is obtained that exhibits adequate bonding properties, corrosion resistance, and heat resistance.

In an electrolytic nickel-plating method, in particular, for the nickle-plating solution and the plating method, the order of process steps performed should be washing→electrolytic nickle-plating→washing →drying. The pH should be adjusted with alkaline nickle carbonate, using a pH range of 4.0 to 4.6 and a solution temperature of 60°.

For nickel plating, the plating solution described in the foregoing is used, the required current is made to flow, using an electrolytic nickel plate, and electrolytic nickel plating is effected. However, in order to stabilize the deposition of the nickel component in the nickel-plating solution described above, it is preferable that an estrand nickel chip containing sulfur be used in the electrode. For the plating solution tank, various types of tank can be used according to the shape of the bonded magnet. In the case of a ring-shaped bonded magnet, a rack-plating or barrel-plating type is preferable.

Embodiments

Embodiment 1

To an alloy powder having an average particle size of 150 $\mu$m and a composition of 12 at. % Nd, 77 at. % Fe, 6 at. % B, and 5 at. % Co, made in a super-rapid-cooling method, 2 wt. % of an epoxy resin were added. This was kneaded and subjected to compression molding under a pressure of 7 ton/cm$^2$, and then heat-treated for at 150° C. for 1 hour to yield ring-shaped bonded magnets having an external diameter of 20 mm, an internal diameter of 18 mm, and a height of 3 mm.

The average magnetic properties of the bonded magnets so obtained were Br=6.9 kG, (BH)max =9.4 MGOe, iHc=9.5 kOe, HK=3.5 kOe, and density=5.90 g/cm$^3$. The surfaces of 100 magnets so obtained were polished in a dry method for 120 minutes, filling a vibrating barrel having a 20-liter capacity to 40% of barrel capacity with $Al_2O_3$ spherical barrel stones having diameters of approximately 3 mm, then introducing 40% vegetable medium made of walnuts having diameters of approximately 1 mm, the surfaces whereof were modified by $Al_2O_3$ powder.

The porosity of the magnets after surface polishing was 0.5% as measured from the oil content calculated by the weight change in the magnets after placing them in oil and applying suction for 10 minutes in a vacuum (0.1 Torr or lower).

Then water rinsing was performed for 2 to 3 minutes and non-electrolytic copper-plating was performed. The plating film thickness was 5 $\mu$m on both the inner and outer sides.

The non-electrolytic plating conditions were a solution temperature of 20° C., plating time of 20 minutes, plating solution composition of 29 g/l copper sulfate, 25 g/l sodium carbonate, 140 g/l tartrate, 40 g/l sodium hydroxide, and 150 ml 37% formaldehyde, and a pH of 11.5.

Next, after water-rinsing for 2 to 3 minutes, electrolytic nickel plating was conducted in a rack method. The nickel plating film thickness was 20 $\mu$m on the inner side and 23 $\mu$m on the outer side. The electrolytic nickel-plating conditions were a cathode current density of 2 A/dm$^2$, plating time of 60 minutes, solution temperature of 55° C., plating solution composition of 240 g/l nickel sulfate, 45 g/l nickel chloride, titrated nickel carbonate (to adjust pH), and 30 g/l boric acid, and a pH of 4.2.

Embodiment 2

Ring-shaped bonded magnets obtained by the same method as in Embodiment 1 were polished and plated under the same conditions as in Embodiment 1 excepting that vegetable matter having diameters of approximately 1 mm consisting simply of walnuts was used instead of the vegetable matter having modified surfaces used in Embodiment 1.

Embodiment 3

Ring-shaped bonded magnets obtained by the same method as in Embodiment 1 were surface-polished as in Embodiment 1 and then water-rinsed for 2 to 3 minutes and subjected to non-electrolytic nickel plating. The plating film thickness on both the inner and outer sides was 4 $\mu$m. The non-electrolytic nickel-plating conditions were a solution temperature of 68° C., plating time of 60 minutes, pH=9.0, and plating solution composition of 20 g/l nickel sulfate, 15 g/l sodium hypophosphite, 30 g/l sodium citrate, and 30 g/l ammonium chloride. Then electrolytic nickel plating was performed as in Embodiment 1.

Comparison 1

Ring-shaped bonded magnets obtained by the same method as in Embodiment 1 were directly subjected to non-electrolytic nickel plating and electrolytic nickel plating as in Embodiment 1.

Comparison 2

Ring-shaped bonded magnets obtained by the same method as in Embodiment 2 were directly subjected to electrolytic nickel plating as in Embodiment 1.

The ring-shaped bonded magnets obtained in Embodiments 1, 2, and 3 and in Comparison 1 and 2 were allowed to stand in a high-temperature high-humidity environment with a temperature of 80° C. and relative humidity of 90%, and the rusting conditions of the bonded magnets were observed after 100 hours and after 500 hours.

In the case of Comparison 2, red rust developed over the entire surface after 100 hours, with the plating not functioning at all. In the case of Comparison 1, magnets were observed with rust spots having diameters of 1 mm or more on their surfaces after 10 hours. In Embodiment 1, Embodiment 2, and Embodiment 3, no rust spots were found capable of recognition under a 30-power microscope even after 500 hours. The changes in magnetic properties before and after the high-temperature high-humidity tests (500 hours) are noted in Table 1 below. The values represented are averages of 20 samples extracted from 100 samples.

TABLE 1

| | New Raw Material | | | Surface Condition in |
|---|---|---|---|---|
| | Br(kG) | iHc | (BH)max | Moisture-Resistance Test |
| Embodiment 1 | 6.9 | 9.0 | 9.0 | No Change(no rusting) |
| Embodiment 2 | 7.0 | 9.0 | 9.0 | No Change(no rusting) |
| Embodiment 3 | 7.0 | 9.0 | 9.0 | No Change(no rusting) |
| Comparison 1 | 6.9 | 9.1 | 9.1 | Rust spots after 100 hours |
| Comparison 2 | 7.0 | 9.0 | 9.0 | Red rusting after 100 hours |

TABLE 2

| | Before Moisture-Resistance Test | | | After Moisture-Resistance Test | | | Rate of Deterioration in Magnetic Properties(%) | | |
|---|---|---|---|---|---|---|---|---|---|
| | Br(kG) | iHc | (BH)max | Br(kG) | iHc | (BH)max | Br(kG) | iHc | (BH)max |
| Embodiment 1 | 6.8 | 9.0 | 9.0 | 6.5 | 8.6 | 8.4 | 5.8 | 4.4 | 6.7 |
| Embodiment 2 | 6.9 | 9.0 | 9.0 | 6.6 | 8.6 | 8.4 | 5.7 | 4.4 | 6.7 |
| Embodiment 3 | 6.9 | 9.0 | 9.0 | 6.6 | 8.7 | 8.5 | 5.7 | 3.3 | 5.6 |
| Comparison 1 | 6.8 | 9.1 | 9.1 | 5.9 | 7.9 | 7.8 | 14.5 | 13.1 | 14.3 |
| Comparison 2 | 6.9 | 9.0 | 9.0 | 5.7 | 8.0 | 7.9 | 18.6 | 11.1 | 12.2 |

[{new material magnetic properties)−(magnetic properties after moisture resistance)}]/(new material magnetic properties]×1000

Industrial Applicability

With the present invention, by subjecting porous R—Fe—B bonded magnets to barrel polishing using a medium that is a mixture of an abrasive agent and a vegetable medium, or a mixture of an abrasive agent and a vegetable medium modified by inorganic powder, the abrasive powder, inorganic powder, and grindings can be bonded by the oil component of the vegetable medium to the porous portion of the R—Fe—B bonded magnets, and those magnets sealed. At the same time, surface smoothing treatment is possible and modification can be made, wherefore, a non-electrolytic plating layer can thereafter be formed directly to the magnet material surface using a neutral or alkaline solution, and, by then forming an electrolytic layer, it is possible to efficiently perform a highly corrosion-resistant plating treatment, whereupon corrosion resistance is obtained wherewith rusting does not occur in high-temperature high-humidity tests of long duration.

What is claimed is:

1. A method for manufacturing a highly corrosion-resistant rare earth metal-Fe—B bonded magnet comprising the steps of:

providing a medium of a mixture of an abrasive agent having a particle size of 1 to 7 mm and one of a vegetable medium having a length of 0.5 to 3 mm and a vegetable medium having a length of 0.5 to 3 mm and having a surface modified by an inorganic powder, the volume ratio of vegetable medium to abrasive agent being 1/5 to 2;

stirring and relatively shifting said medium and said earth metal-Fe—B bonded magnet by a dry barreling method to produce a powder of said abrasive agent and bonded magnet grindings and/or said inorganic powder and to make the surface of said rare earth metal-Fe—B bonded magnet smooth, a mixture ratio of bonded magnet to medium being no more than 3;

embedding said powder of abrasive agent and said bonded magnet grindings and/or said inorganic powder into porous portions of said rare earth metal-Fe—B bonded magnet;

sealing the thus embedded porous portions of said rare earth metal-Fe—B bonded magnet with an oil component of said vegetable medium;

forming a first metal plating layer directly on the surfaces of said bonded magnet by electroless-plating with a neutral or alkaline solution; and then forming a second metal plating layer on said first metal plating layer by electrolytic plating.

2. The method for manufacturing a highly corrosion-resistant rare earth metal-Fe—B bonded magnet according to claim 1, wherein said abrasive agent is either abrasive stone wherein inorganic powder is baked and hardened or metal balls.

3. The method for manufacturing a highly corrosion-resistant rare earth metal-Fe—B bonded magnet according to claim 1, wherein said vegetable medium is sawdust, fruit rind, or corncobs.

4. The method for manufacturing a highly corrosion-resistant rare earth metal-Fe—B bonded magnet according to claim 1, wherein a magnet porosity of said bonded magnet after surface smoothing treatment is 3% or lower.

5. The method for manufacturing a highly corrosion-resistant rare earth metal-Fe—B bonded magnet according to claim 1, wherein said first plating layer comprises at least one base metal selected from the group consisting of Ni, Cu, Sn, Co, Zn, Ag, Au, and Pd.

6. The method for manufacturing a highly corrosion-resistant rare earth metal-Fe—B bonded magnet according to claim 1, wherein a thickness of said first plating layer is 1 to 7 $\mu$m.

7. A method for manufacturing a highly corrosion-resistant rare earth metal-Fe—B bonded magnet according to claim 1, wherein said bonded magnet grindings have a particle size of 0.01 to 3 $\mu$m.

* * * * *